US008411405B2

(12) United States Patent
Blackburn et al.

(10) Patent No.: US 8,411,405 B2
(45) Date of Patent: Apr. 2, 2013

(54) DEVICE FOR ELECTRICALLY DISCHARGING SAMPLES OF AN ELECTRICALLY NONCONDUCTIVE LIQUID

(76) Inventors: Michael J. Blackburn, Morris, IL (US); Donald G. Flaynik, Jr., Channahon, IL (US)

( * ) Notice: Subject to any disclaimer, the term of this patent is extended or adjusted under 35 U.S.C. 154(b) by 0 days.

(21) Appl. No.: 13/374,397

(22) Filed: Dec. 27, 2011

(65) Prior Publication Data

US 2012/0140372 A1 Jun. 7, 2012

Related U.S. Application Data

(63) Continuation-in-part of application No. 12/462,982, filed on Aug. 12, 2009, now Pat. No. 8,111,497.

(51) Int. Cl.
*H05F 3/00* (2006.01)
*H05F 3/05* (2006.01)

(52) U.S. Cl. ..... 361/215; 361/216; 361/220

(58) Field of Classification Search ..... 361/215
See application file for complete search history.

(56) References Cited

U.S. PATENT DOCUMENTS 5,754,388 A * 5/1998 Schmidt ..... 361/215
5,898,560 A * 4/1999 Flaynik et al. ..... 361/215

* cited by examiner

*Primary Examiner* — Dharti Patel
(74) *Attorney, Agent, or Firm* — Donald Flaynik

(57) ABSTRACT

A device 10 for electrically discharging samples of an electrically non-conductive liquid includes an electrically conductive outer member 12, an electrically conductive inner member 14 disposed within the outer member 12, an electrically conductive rod 16 with upper and lower plugs 18 and 19 secured thereto to maintain a non-conductive fluid in the device 10, non-conductive handles 20 and 22 secured to the outer and inner members 12 and 14, and an electrically conductive ground cable 26 detachably secured to the rod 16 to ultimately remove or reduce static charge in the electrically non-conductive liquid via the liquid engaging the outer member 12, inner member 14 and rod 16, which are electrically grounded via the cable 26.

18 Claims, 17 Drawing Sheets

DEVICE FOR ELECTRICALLY DISCHARGING SAMPLES OF AN ELECTRICALLY NONCONDUCTIVE LIQUID

This is a Continuation-In-Part application that is based on application Ser. No. 12/462,982, filed Aug. 12, 2009 now U.S. Pat. No. 8,111,497.

BACKGROUND OF THE INVENTION

1. Field of the Invention

The present invention relates generally to devices for collecting samples from drums and vessels containing liquids and, more particularly, to collecting samples from drums and vessels containing electrically nonconductive liquid with an electrical static charge buildup thereupon.

2. Background of the Prior Art

Oil refineries and chemical plants routinely analyze hydrocarbon liquids in their process flow streams to determine if the resulting products meet specifications. Generally, a person will dip a collection tube into a drum, vessel or similar container to collect a sample of a hydrocarbon liquid within. After collecting a sample, the person carries the collection tube and sample therein back to a lab for analysis.

A dangerous situation occurs when a statically charged hydrocarbon liquid sample is collected. The statically charged hydrocarbon liquid in the collection tube can transfer a substantial quantity of the static charge to the collection tube, irrespective of the collection tube being fabricated from electrically conductive or nonconductive material, resulting in an electrical arc when the collection tube engages a grounded structure. The electrical arc can start a fire or initiate an explosion if the surrounding area provides an explosive atmosphere.

A need exists for a grounded metal collection tube that includes inner members capable of discharging the static charge from a nonconductive hydrocarbon liquid while the hydrocarbon liquid is collected from inside a barrel, vessel or similar container. Further, a need exists for a collection device fabricated from resistive materials, which may be electrically grounded or not grounded, that collects a hydrocarbon liquid such that a spark not generated when the collection device engages the hydrocarbon liquid, or when the collection device is removed from the hydrocarbon liquid after the device collects and maintains therein a relatively small portion of the liquid.

SUMMARY OF THE INVENTION

A principle object of the present invention is to provide a device for electrically discharging samples of an electrically nonconductive liquid. A feature of the device is an electrically conductive outer member. Another feature of the device is an electrically conductive inner member. Yet another feature of the device is an electrically conductive member that electrically connects the conductive inner member to the conductive outer member. An advantage of the device is that an electrically nonconductive liquid that is statically charged is allowed to enter the outer member via an open bottom and rise within the outer member to engage the inner and outer members, and the connecting member, thereby safely removing the static charge from a selected quantity of the nonconductive liquid that will ultimately be analyzed.

Another object of the present invention is to electrically ground the outer and inner members, and the connecting member before allowing the device to engage a statically charged nonconductive liquid. A feature of the device is a grounding cable with electrically conductive clamps attached to opposite ends of the grounding cable. Another feature of the device is a collar for detachably receiving one of the electrically conductive clamps, the collar being electrically connected to the inner member. An advantage of the device is that the collar and clamp cooperate to electrically ground the statically charged nonconductive fluid immediately upon contacting the outer and inner members, thereby preventing electrical arcs that could cause an explosion.

Yet another object of the present invention is to seal the outer member such that the collected sample therein will not escape after removing the device from a drum or vessel containing the electrically nonconductive liquid. A feature of the device is upper and lower plugs for the outer member that are forcibly urged into the outer member by a spring cooperating with a channel spacer. An advantage of the device is that the outer member and the sample therein can be manually transported to an analyzing location without endangering the person or the environment.

Another object of the present invention is to provide an alternative device for electrically discharging samples of an electrically non-conductive liquid such that a spark is not generated, irrespective of the device being grounded or not grounded, when the alternative device engages the non-conductive liquid or when the alternative device is removed from the non-conductive liquid with the sample therein. A feature of the alternative device is the fabrication of all components from resistive materials. An advantage of the alternative device is that the resistive materials restrict the energy dissipation from the liquid to an electrically grounded structure to quantities that cannot generate sparks, thereby preventing fires and/or explosions irrespective of the air-fuel mixture adjacent to the liquid.

Yet another object of the present invention is to provide an alternative device having biasing means for forcibly sealing an outer member containing a non-conductive liquid therein. A feature of the alternative device is a manually positioned channel that receives an inner member therein. Another feature of the alternative device is a deformable spacer and a deformable upper plug that engage by the channel. An advantage of the alternative device is that the channel compresses the spacer and upper plug such that the upper plug and a lower plug are forcibly urged into upper and lower apertures in the outer member, thereby trapping the non-conductive liquid in the outer member to allow the alternative device and the trapped liquid therein to be transported to a lab for testing.

Briefly, the invention provides a device for electrically discharging samples of an electrically non-conductive liquid comprising an electrically conductive outer member; an electrically conductive inner member disposed within said electrically conductive outer member; means for allowing an electrically non-conductive liquid to enter said electrically conductive outer member when said device is disposed in the non-conductive liquid; means for electrically discharging the non-conductive liquid entering said outer conductive member; means for maintaining a selected volume of the non-conductive liquid in said outer conductive member after said device is removed from the non-conductive liquid; and means for electrically grounding said inner and outer electrically conductive members, and said electrical discharging means for the non-conductive liquid entering said outer conductive member.

The invention further provides a system for electrically discharging non-conductive liquid samples before being removed from a vessel comprising means for receiving a predetermined quantity of non-conductive liquid; means for electrically discharging the non-conductive liquid as the nonconductive liquid enters and fills said receiving means, said electrical discharging means comprising an electrically conductive inner member that engages the non-conductive liquid entering said receiving means; and means for grounding said electrically conductive inner member, said grounding means being detachably secured to said electrically conductive inner member and an electrically grounded structure; means for manually sealing a predetermined quantity of the non-conductive liquid in said receiving means; and means for manually releasing the non-conductive liquid from said receiving means, thereby providing a sample of the non-conductive liquid for evaluation.

The invention also provides a method for removing static charge from a selected quantity of non-conductive liquid, said method comprising the steps of providing an electrically conductive container with bottom and top apertures; inserting an electrically conductive inner member into said container, said inner member ultimately engaging an inner wall of said container; installing plugs on bottom and top portions of said inner member, said plugs being configured and dimensioned to seal said bottom and top apertures in said container after a selected quantity of non-conductive liquid has entered said container; providing means for manually urging said inner member in said container to ultimately seal said bottom and top apertures in said container via said plugs, said plugs being slidably disposed upon said inner member; and connecting grounding means to said inner member, whereby the non-conductive liquid entering said container is electrically discharged until said grounding means is detached from said inner member, whereupon, the container and the electrically discharged non-conductive liquid therein are transported to a testing lab.

BRIEF DESCRIPTION OF THE DRAWINGS

These and other objects, advantages an novel features of the present invention, as well as details of an illustrative embodiment thereof, will be more fully understood from the following detailed description and attached drawings, wherein.

DESCRIPTION OF THE PREFERRED EMBODIMENT

Figure 1:
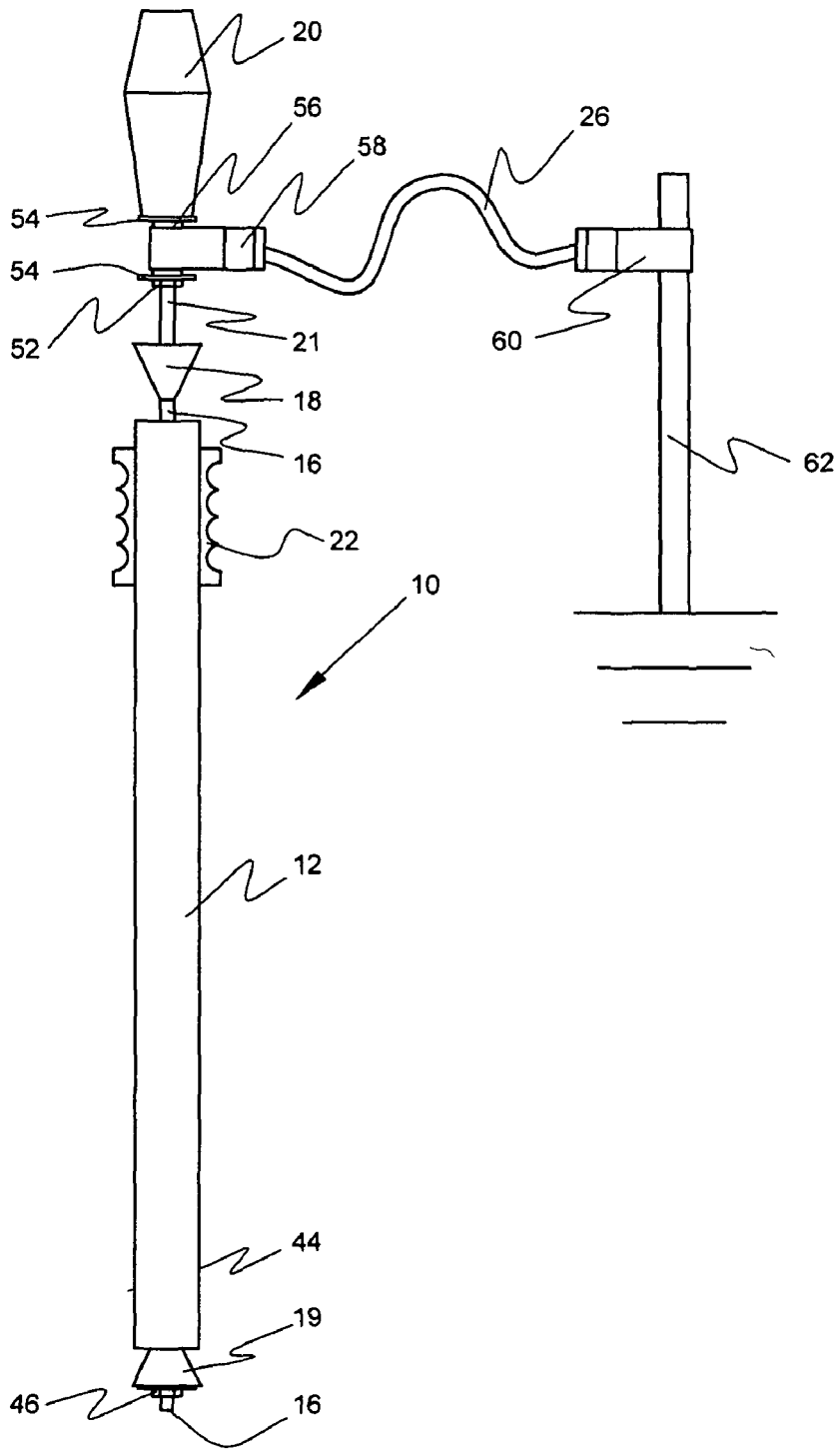
FIG. 1 is a front elevation view of a device for electrically discharging the static charge in samples of an electrically non-conductive liquid in accordance with the present invention.
Figure 2:
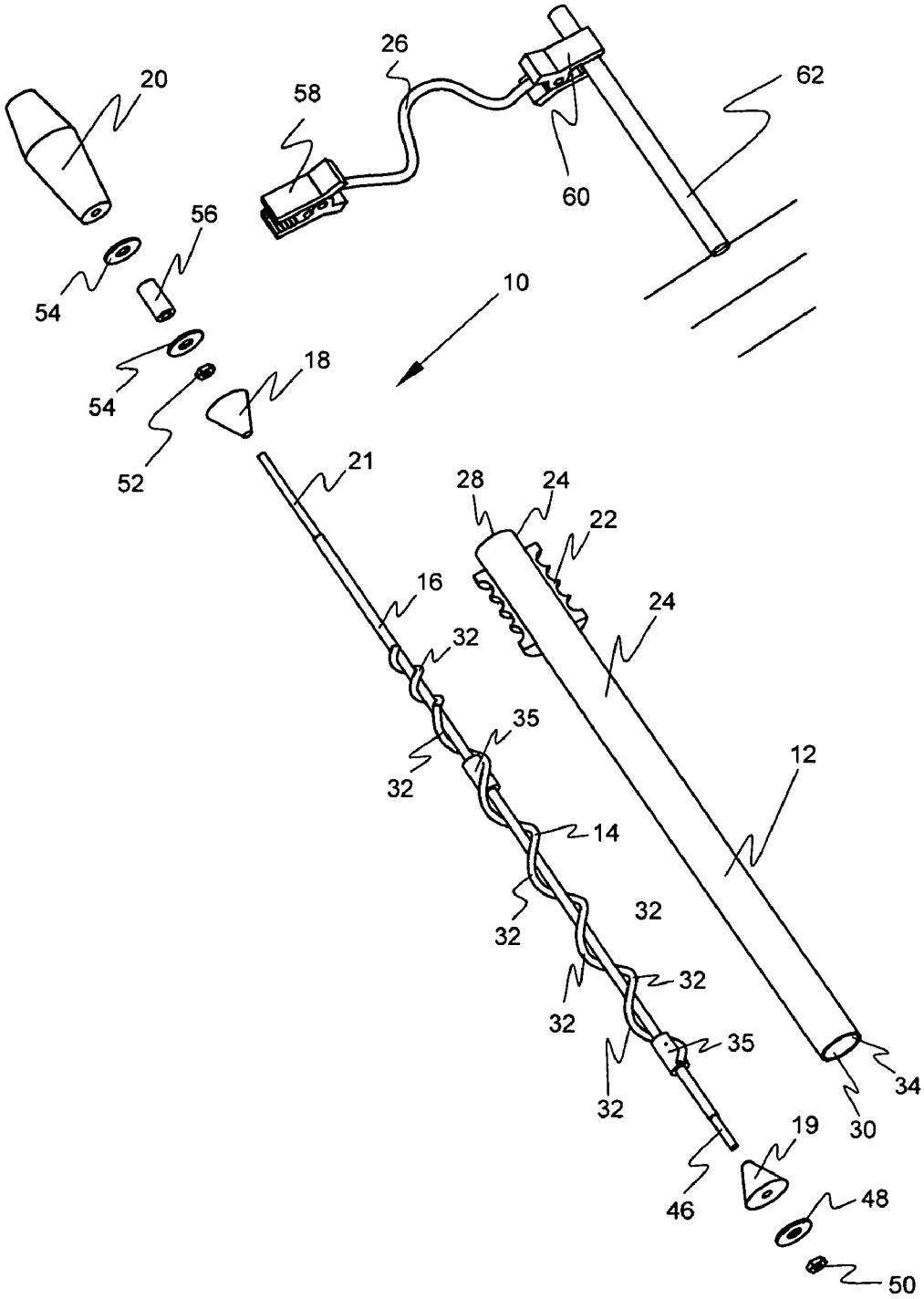
FIG. 2 is an exploded view of the device of FIG. 1.

Referring now to FIGS. 1 and 2, a device for electrically discharging the static charge on samples of an electrically non-conductive liquid in accordance with the present invention is denoted as numeral 10. The device 10 includes an electrically conductive outer member 12; an electrically conductive inner member 14 spirally disposed within the outer member 12; an electrically conductive rod 16 with upper and lower plugs 18 and 19 secured thereto to maintain a non-conductive fluid in the device 10, the rod 16 being electrically connected to the outer and inner members 12 and 14; an electrically non-conductive rod handle 20 secured to a top portion 21 of the rod 16 for manually disposing the rod 16 inside the outer member 12; an electrically non-conductive handle 22 secured to a top portion 24 of the outer member 12 for manually holding the outer member 12 while the rod 16 is manually disposed inside the outer member 12; and an electrically conductive ground cable 26 detachably secured to the rod 16, whereby the static charge in an electrically non-conductive liquid in a container or vessel is ultimately discharged to ground via the non-conductive liquid engaging the outer member 12, inner member 14 and rod 16, which are electrically grounded via the cable 26.

The outer member 12 is a thin-walled, cylindrically configured tube dimensioned to provide a volume that promotes insertion into a vessel or container to withdraw a predetermined volume of non-conductive liquid for testing and evaluation. The outer member 12 is manufactured from a relatively light weight electrically conductive metal such as aluminum or copper, and includes upper and lower apertures 28 and 30 to receive and remove the non-conductive liquid. The non-conductive handle 22 is fabricated from plastic or similar material and secured to the top portion 24 of the outer member 12. The handle 22 promotes the manual grasping of the outer member 12 while protecting the operator from static electricity in the non-conductive liquid when engaged by the outer member 12 as the operator inserts the device 10 into the liquid.

Figure 4:
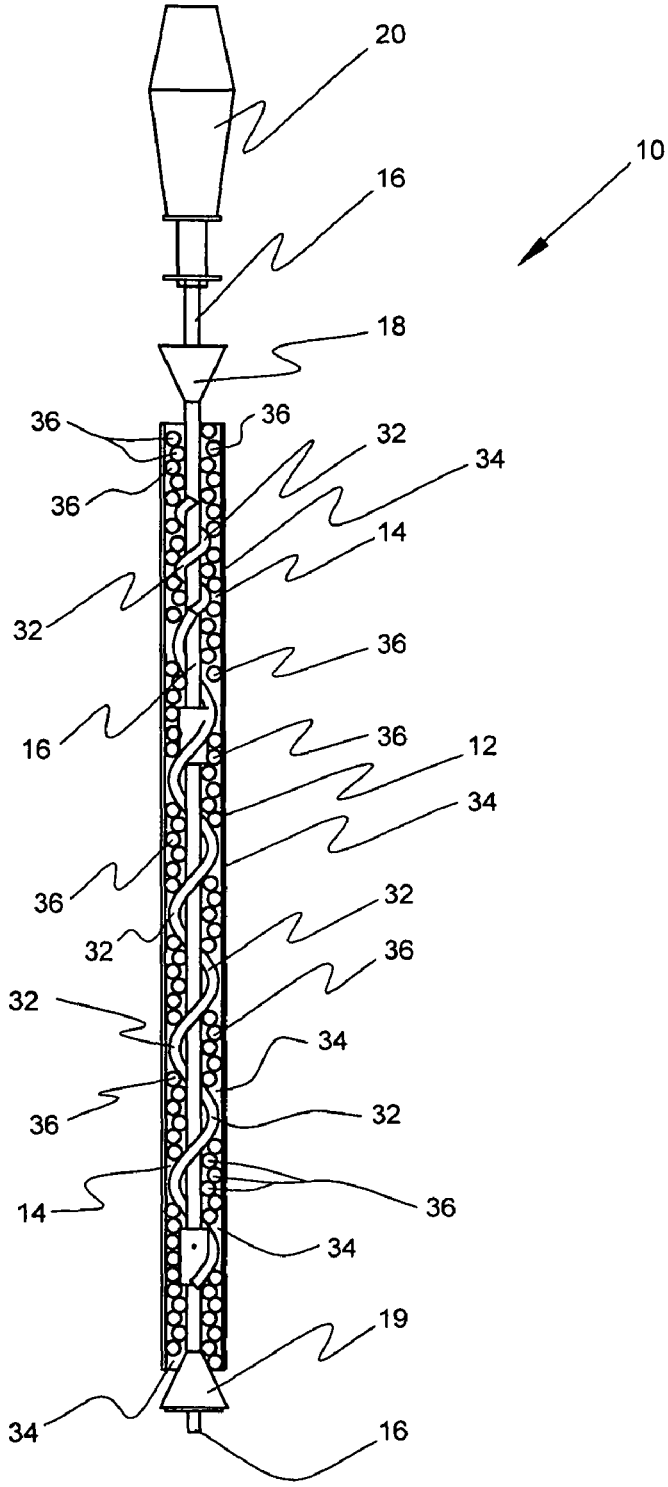
FIG. 4 is a phantom view of the device of FIG. 3, but with metal spheres included therein in accordance with the present invention.
Figure 5A:
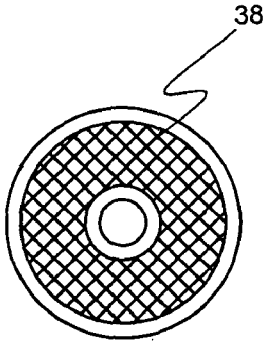
FIG. 5*a* is a top elevation view of the screens of FIG. 5.
Figure 5:
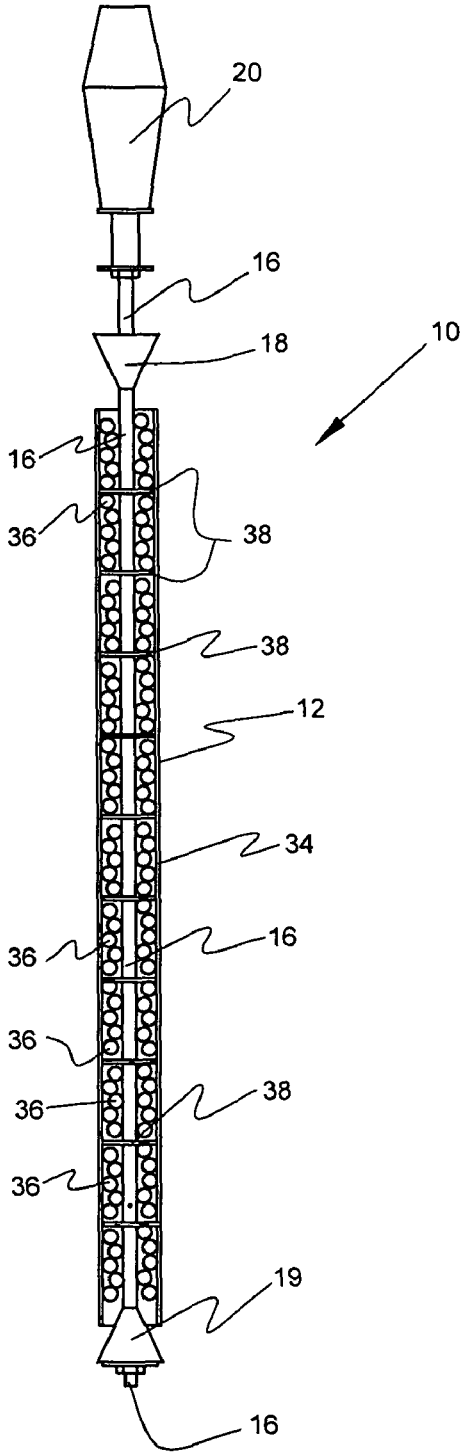
FIG. 5 is a phantom view of the device of FIG. 4, but with metal screens included therein in accordance with the present invention.
Figure 6A:
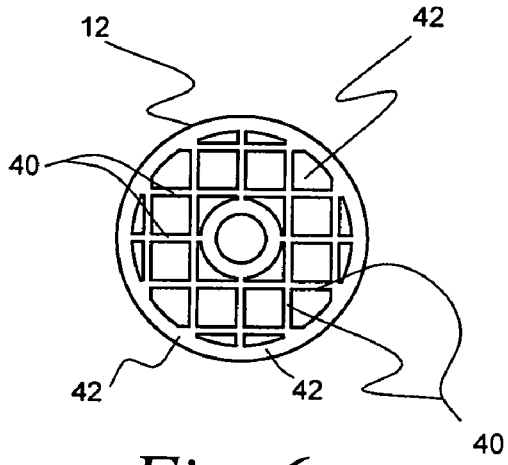
FIG. 6*a* is a top elevation view of the grid pattern of FIG. 6.
Figure 6:
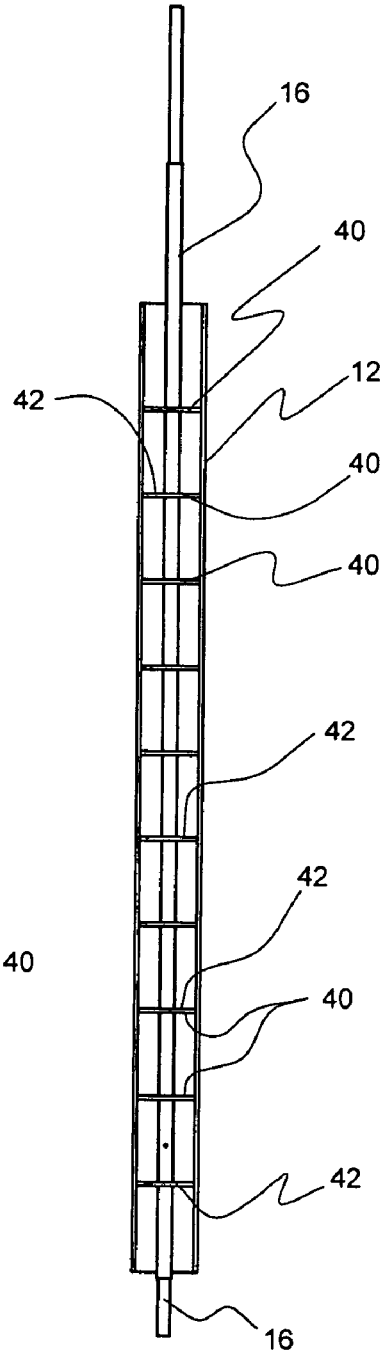
FIG. 6 is a phantom view of the device of FIG. 5, but with metal bars forming a grid pattern replacing the screens and spheres therein in accordance with the present invention.

The inner member 14 is an electrically conductive piece of copper or aluminum spiraling about the rod 16 such that outer portions 32 of the inner member 14 engage an inner cylindrical wall 34 of the outer member 12, thereby promoting electrical continuity between the outer and inner members 12 and 14, and the rod 16 to ultimately discharge the static charge in the non-conductive liquid collected in the outer member 12 to ground via the ground cable 26. The inner member 14 is secured to the rod via soldering or similar methods. Two enlarged couplings 35 are integrally secured to the rod 16 to provide a relative large surface area to better secure the inner member 14 to the rod 16. The spiraling inner member 14 is suitable for relatively viscous or "thick" liquids. In the event a relatively non-viscous or "thin" liquid requires discharging, a plurality of small spherical copper or aluminum balls 36 may be disposed in the outer member 12 (see FIG. 4) such that the balls 36 engage the inner and outer members 12 and 14, and the rod 16 to provide increased static discharge capability; or the balls 36 alone may fill the outer member 12 without the inner member 14, but including the rod 16 such that the balls 36 engage the outer member 12 and the rod 16. Alternatively, a series of conductive screens 38 may replace the inner member 14 (see FIGS. 5 and 5*a*), or a combination of screens 38 and balls 36 can be utilized. Further, a plurality of relative long, "thin" copper or aluminum "flat bars" 40 may be integrally joined to form a grid 42 configuration (see FIGS. 6 and 6*a*).

Irrespective of the configuration of electrically conductive elements included in the outer member 12, the goal is to remove the electrostatic charge from the non-conductive liquid before the device 10 is manually removed from the vessel or container holding the non-conductive liquid. The electrostatic charge is removed via the non-conductive liquid entering the lower aperture 30 of the outer member 12, then rising within the outer member 12 and around or through the inner member 14 and/or balls 36, screens 38 or flat bars 40 until rising to a level that provides a sufficient volume of electrostatically discharged, non-conductive liquid for laboratory testing and evaluation. The more engagement between the volume of non-conductive liquid and the outer member 12, inner member 14 or substitute elements, and the rod 16, the lower the electrostatic charge remaining on the non-conductive liquid when the device is removed from the vessel or container, thereby reducing the chance of an electrostatic arc which could cause a fire or explosion in the event of combustive or explosive vapors being present.

The non-conductive liquid is manually collected in the device 10 by the operator holding the device 10 via non-conductive handles 20 and 22 to prevent the operator from being exposed to a static charge, the operator then pushes on the handle 20 secured to the top portion 21 of the rod 16 by threads or similar methods, until a frustoconically configured lower plug 19, manufactured from a deformable material such as rubber or a conductive or semi-conductive material, is separated from the lower aperture 30. The lower plug 19 is dimensioned to cooperate with the diameter of the lower aperture 30 such that the lower plug 19 is capable of sealing the bottom end of the outer member 12 after the non-conductive liquid enters the outer member 12. The operator then grounds the rod 16, the inner and outer members 14 and 12 electrically connected thereto, and any balls 36 or screens 38 inside the outer member 12 by manually attaching a first clamp 58 to a collar 56 and a second clamp 60 to a ground bar 62 or similar well grounded metal structure, the ground cable 26 provides electrical continuity between the clamps 58 and 60. The operator then inserts the lower end 44 of the outer member 12 into the non-conductive liquid such that a tip portion 46 of the rod 16 first engages the liquid, thereby reducing the chance of an arc between the surface of the non-conductive liquid and the device 10. The operator inserts the lower end 44 of the outer member 12 deeper into the liquid until the liquid rises inside the outer member 12 to a level that provides a predetermined volume of liquid inside the device 10 for removal from the container, whereupon, the operator pulls the rod handle 20 upward until the lower plug 19 is re-inserted into the lower aperture 30 to prevent the non-conductive liquid from escaping from the outer member 12. To prevent the liquid from spilling from the upper aperture 28 in the outer member 12, the upper plug 18, manufactured from the same deformable frustoconically configured material as the lower plug 19, is manually pushed into the upper aperture 28, thereby sealing the non-conductive liquid inside the device 10, and allowing the device 10 to be removed from the container; whereupon, the second clamp 60 is ultimately detached from the ground bar 62 and the device 10 with the non-conductive liquid therein is transported by the operator to a distal location where the liquid is tested and/or evaluated.

The lower plug 19 is removably secured to the threaded tip portion 46 of the rod 16 by a washer 48 and nut 50. The upper plug 18 is slidably maintained on the treaded top portion 21 of the rod 16 by a nut 52. The nut 52 cooperates with two washers 54 and the rod handle 20 to maintain the longitudinal position of the metal collar 56 upon the top portion 21 of the rod 16 such that the rod 16 is electrically connected to the collar 56, resulting in electrical continuity between the rod 16, the metal clamps 58 and 60, the cable 26 and the grounded bar 62 to effectively ground the static charge in the collected non-conductive liquid. The collar 56 detachably receives the first clamp 58 which is secured to a first end of the grounding cable 26. A second end of the grounding cable 26 is secured to the second clamp 60 which detachably secured to the selected grounded metal bar 62 or similar grounded structure.

Figure 7:
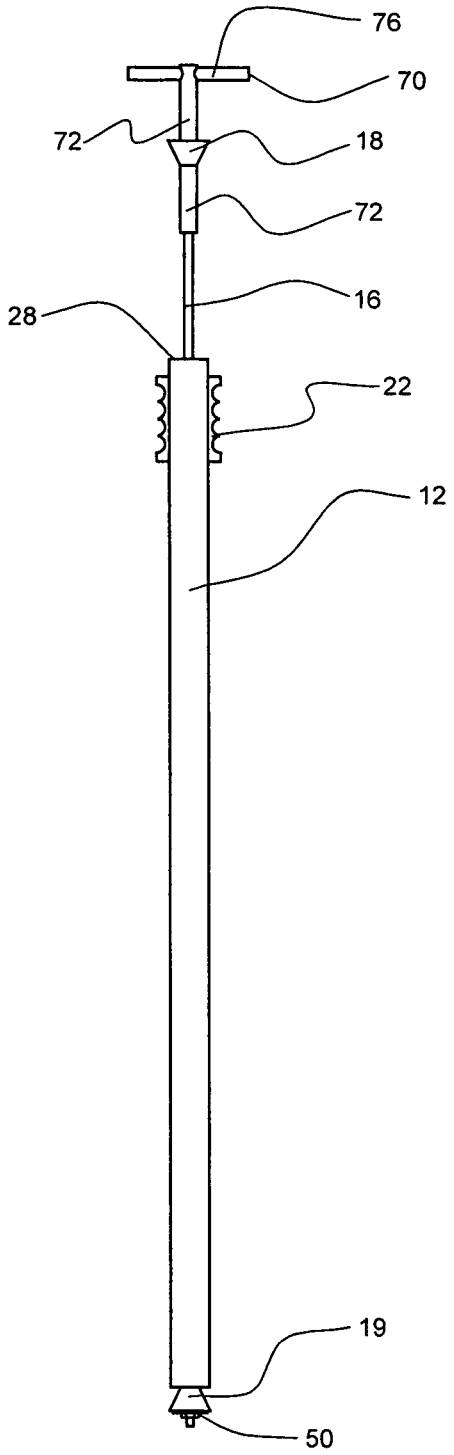
FIG. 7 is a front elevation view of the device of FIG. 1, but with an alternative handle design in accordance with the present invention.
Figure 8:
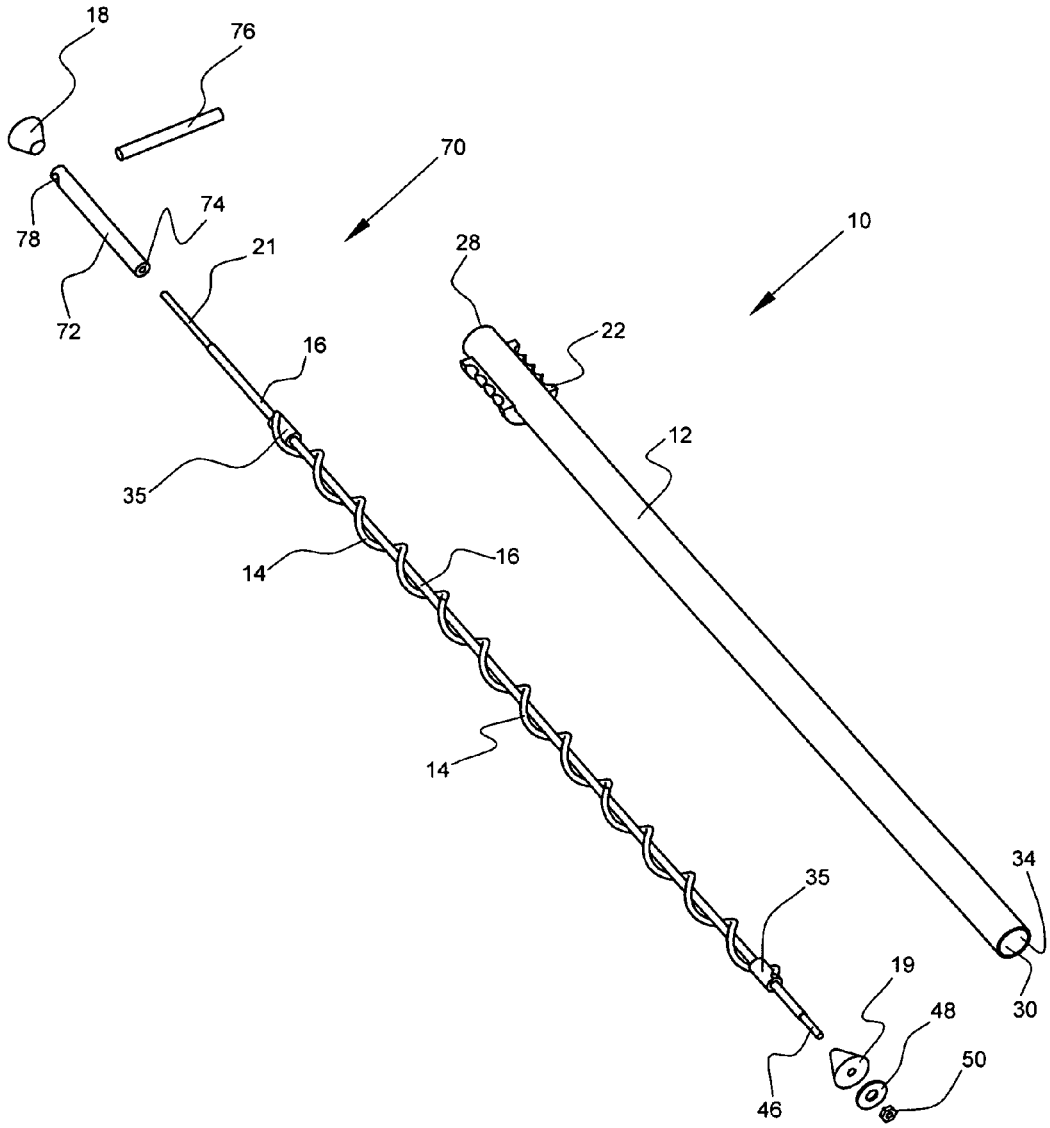
FIG. 8 is an exploded view of the device of FIG. 7.
Figure 9:
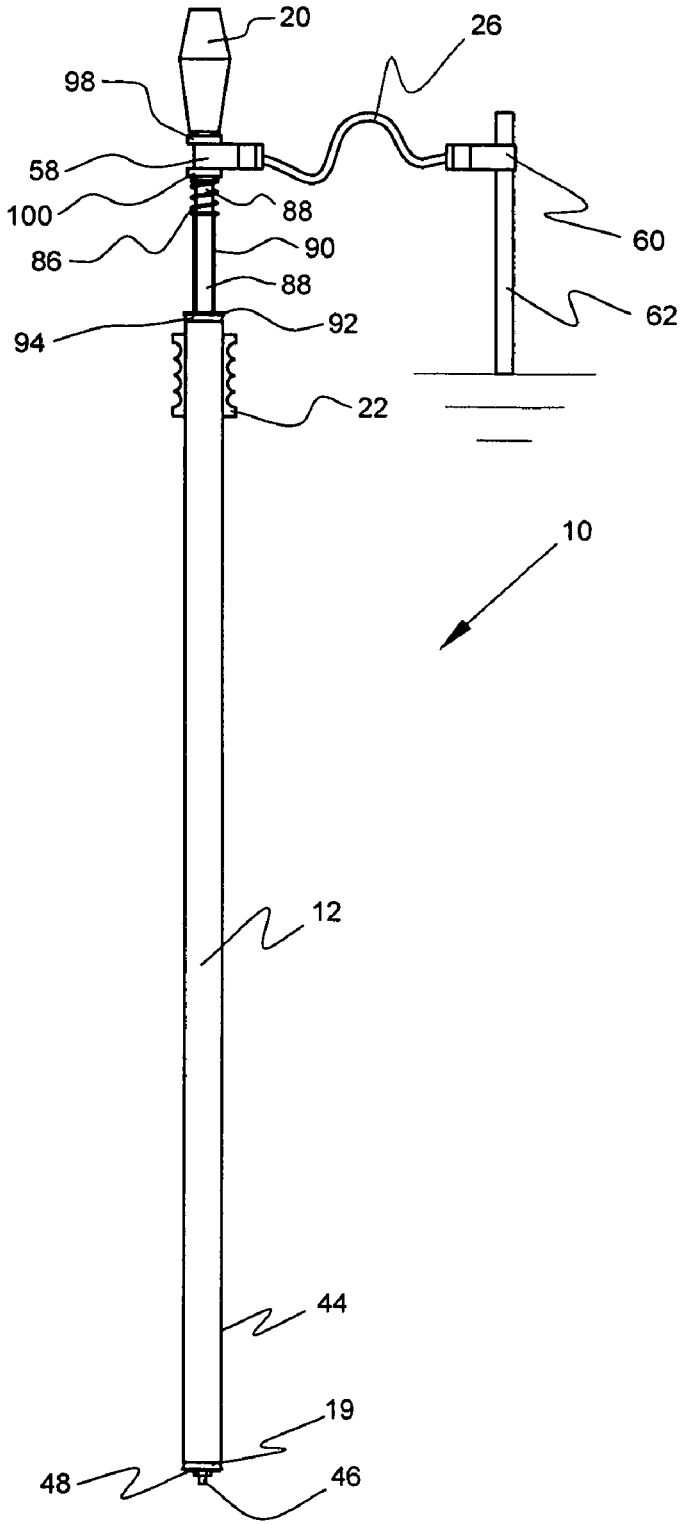
FIG. 9 is a front elevation view of the device of FIG. 1, but with a modified upper portion in accordance with the present invention. The device of FIG. 9 is depicted with a lower plug disposed in a closed position to prevent a sample from escaping an outer member of the device.
Figure 10:
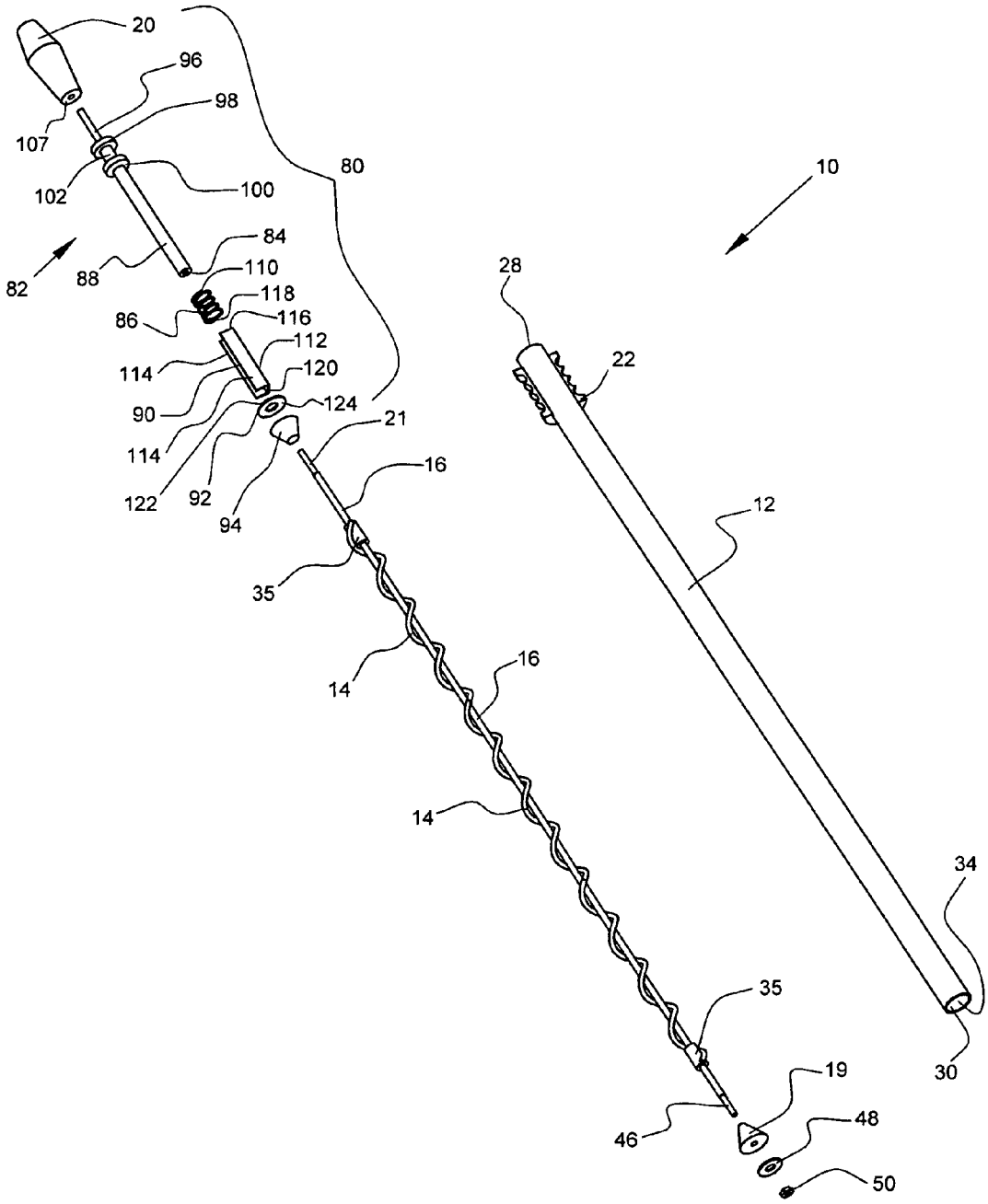
FIG. 10 is an exploded perspective view of the device of FIG. 9.
Figure 11:
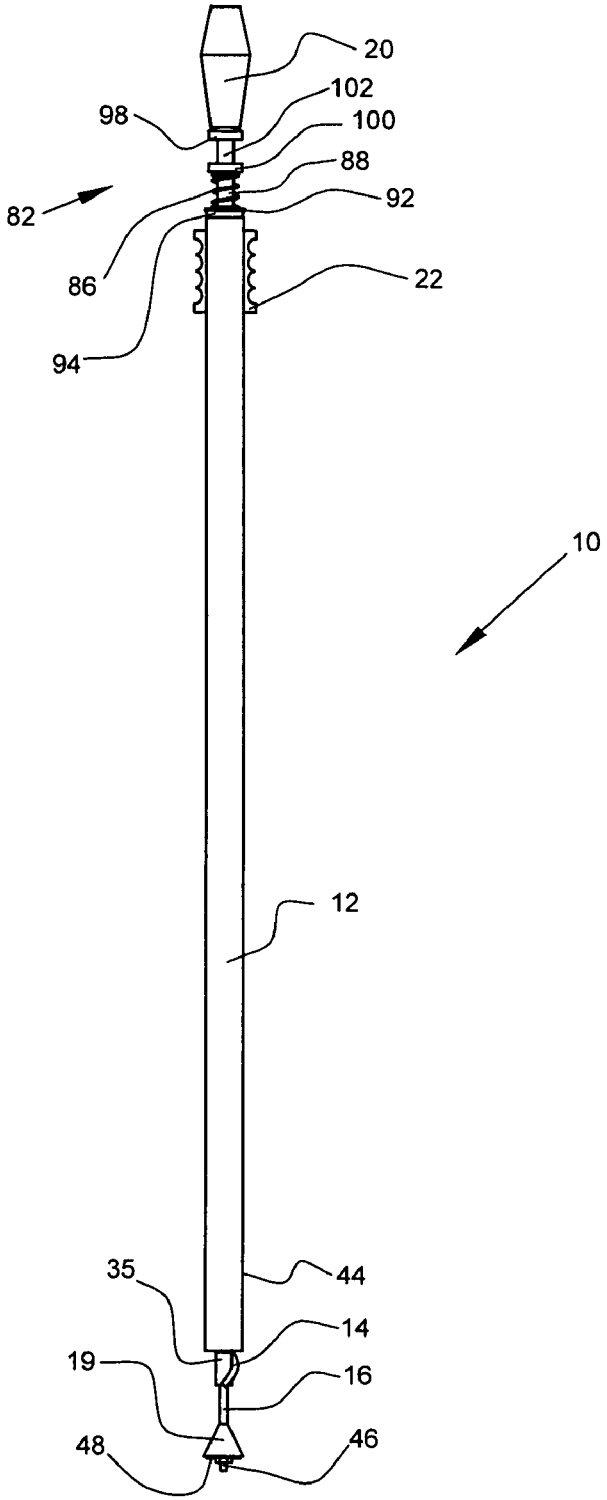
FIG. 11 is a front elevation view of the device of FIG. 9, but with a channel spacer removed and a lower plug disposed in an open position to allow a sample to flow into an outer member of the device in accordance with the present invention.
Figure 12:
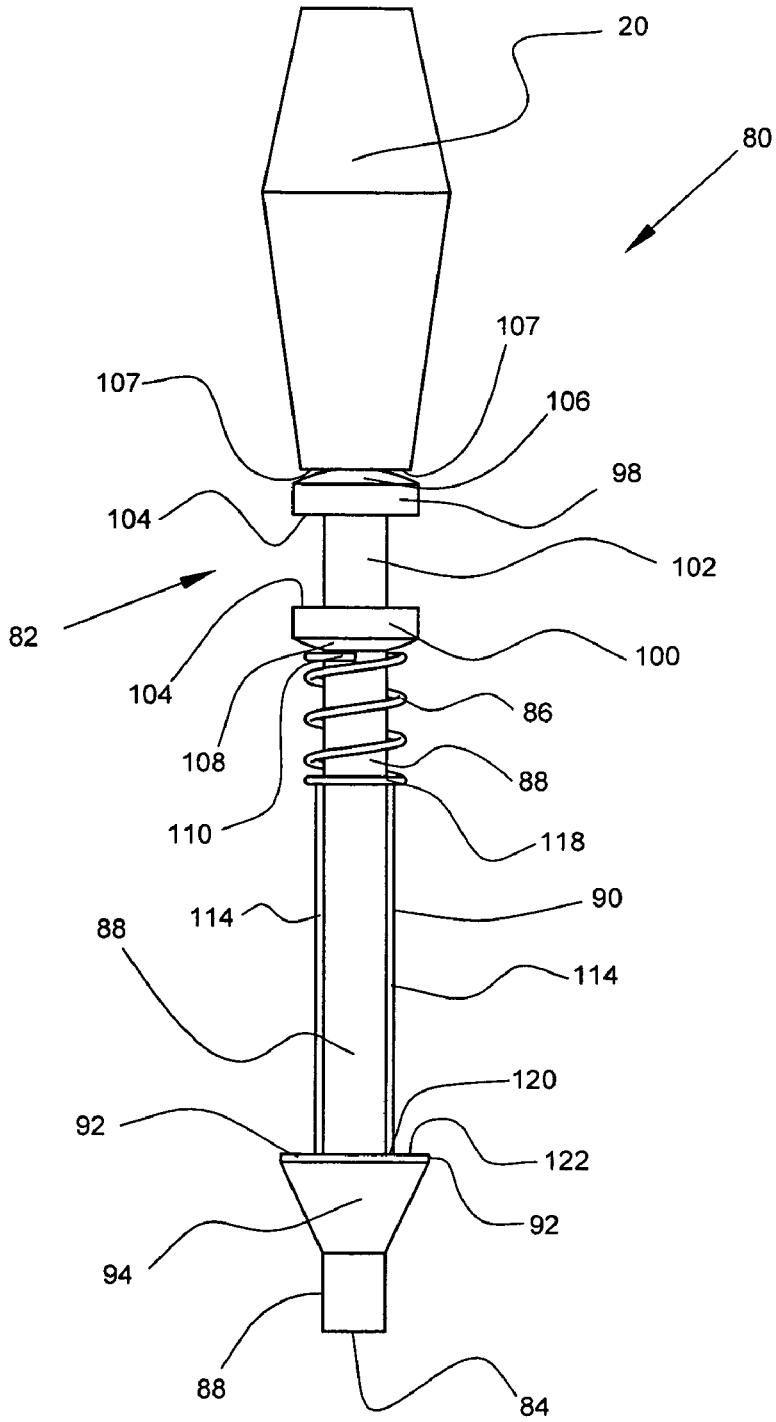
FIG. 12 is a front elevation view of the modified upper portion of FIG. 9.

Referring now to FIGS. 7 and 8, an alternative design for the handle of the device 10 is depicted and designated as numeral 70. The handle is manufactured from a non-conductive material and includes a "T" configuration to promote better grasping by the operator to allow the operator impart more force upon device 10 when inserting or removing the upper and lower plugs 18 and 19 from cooperating upper and lower apertures 28 and 30. The handle 70 is secured to the top portion 21 of the rod 16 by threads such that the top portion 21 is completely threaded and inserted into a base portion 72 of the handle 70 to ultimately dispose a tip portion 74 of the base portion 72 into the upper aperture 28 in the outer member 12, thereby stabilizing the handle 70 after the upper plug 18 is slid down the base portion into the upper aperture 28. A cross member 76 is snugly and removably inserted through an aperture 78 in the base portion. The cross member 76 is configured and dimensioned such that the operator's entire hand grasps the cross member 76, thereby promoting increased manual force longitudinally upon the rod 16, resulting in tighter seals between the upper and lower plugs 18 and 19, and cooperating ends of the outer member 12.

Referring now to FIGS. 9-12, a modified upper portion for the device 10 in accordance with the present invention is denoted as numeral 80. The modified upper portion 80 includes an elongated collar 82 with a threaded aperture 84 that rotationally receives the threaded top portion 21 of the conductive rod 16, a cylindrical spring 86 that slides upon a cylindrical lower portion 88 of the elongated collar 82, a channel spacer 90 that is forcibly disposed upon the lower portion 88 of the elongated collar 82, a washer 92 that slides upon the lower portion 88, and an upper plug 94 that is forcibly disposed upon the lower portion 88.

The elongated collar 82 is manufactured from a single piece of aluminum and further includes a threaded cylindrical top portion 96 that rotationally inserts into the handle 20, and first and second cylindrical clamp retainers 98 and 100 with a cylindrical clamp portion 102 therebetween for receiving the first clamp 58. The first and second clamp retainers 98 and 100 are separated a distance corresponding to the axial dimension of the clamp portion 102 required to allow the first clamp 58 to snugly insert between the first and second clamp retainers 98 and 100, then be removably secured to the clamp portion 102. The first and second clamp retainers 98 and 100 have planar inner walls 104 with radial dimensions sufficient to engage and retain the first clamp 58, thereby preventing the clamp 58 from sliding off the clamp portion 102. The first clamp retainer 98 includes an arcuate outer wall 106 configured to snugly engage a bottom portion 107 of the handle 20. The second clamp retainer 100 includes a conically configured outer wall 108 dimensioned to cooperatively engage a first end 110 of the spring 86, such that the spring remains concentrically disposed about the lower portion 88 when compressed, thereby preventing the spring 86 from engaging and damaging the lower portion 88.

The lower portion 88 includes an axial dimension that is relatively longer than the combined axial dimensions of the spring 86 (not compressed), channel spacer 90, washer 92 and upper plug 94, thereby preventing the upper plug 94 from sliding off the elongated collar 82 during operation of the device 10. The spring, washer 92 and upper plug 94 must be slid upon the elongated collar 82 before the threaded top portion 21 of the conductive rod is rotationally inserted into the elongated collar 82. The channel spacer 90 has one side open and therefore can be disposed upon the lower portion 88 after the top portion 21 is rotationally secured to the lower portion 88.

The spring 86 is manufactured from stainless steel and includes an axial dimension approximately one-half the longitudinal dimension of the channel spacer 90 when the spring 86 is in a non-compressed state. The axial dimension of the spring 86 and longitudinal dimension of the channel spacer 90 cooperate to maintain sufficient pressure on the upper plug 94 to prevent the upper plug 94 and/or the lower plug 19 from allowing a sample collected in the outer member 12 from escaping until the collected sample is intended to be removed from the outer member 12. The spring 86 includes an inner diameter slightly longer than the outer diameter of the lower portion 88, and an outer diameter relatively smaller than the outer diameter of the second clamp retainer 100, thereby allowing the spring 86 to snugly slide onto the lower portion 88 until engaging the conical outer wall 108 of the second clamp retainer 100. The spring 86 compression parameters are such that a person using the device 10 can compress the spring 86 to a position that ultimately provides sufficient bias to the channel spacer 90 to maintain the positions of the upper and lower plugs 94 and 19 in the outer member 12 such that no sample will escape the outer member 12.

The channel spacer 90 includes a base side 112 and two retaining sides 114 perpendicularly joined to the base side 112 such that the retaining sides 114 are laterally separated a distance slightly less than the outer diameter of the lower portion 88. The lateral separation of the retaining sides 114 allows an operator of the device 10 to forcibly urge the base side 112 and the retaining sides 114 of the channel spacer 90 into longitudinal engagement with the lower portion 88, thereby providing a bias that retains the channel spacer 90 upon the lower portion 88 after the operator releases the channel spacer 90. After the operator takes a sample and forces the upper and lower plugs 94 and 19 into the outer member 12, the spring 86 is compressed and the channel spacer 90 inserted between the spring 86 and washer 92 such that a first end 116 of the channel spacer 90 forcibly engaging a second end 118 of the spring 86, a second end 120 of the channel spacer 90 forcibly engaging a first side 122 of the washer 92, and a second side 124 of the washer 92 forcibly engages the upper plug 94, thereby maintaining the upper and lower plugs 94 and 19 in the outer member 12.

The washer 92 is manufactured from stainless steel and dimensioned to engage the second end 120 of the channel spacer 90 and the upper plug 94. The upper plug 94 is configured and dimensioned substantially the same as the lower member 19, except that the axial aperture through the upper plug 94 has a diameter relatively larger than the diameter of the axial aperture through the lower member 19. Also, the axial aperture through the upper plug 94 is relatively smaller than the outer diameter of the lower portion 88 of the elongated collar 82 to forcibly maintain the upper plug 94 upon the lower portion 88 during slidable operation of the upper plug 94 upon the lower portion 88 when collecting samples with the device 10.

In operation, a device 10 having a modified upper portion 80 is grounded via the first clamp 58 detachably secured to the clamp portion 102 of the elongated collar 82, and the second clamp 60 detachably secured to a grounded metal bar 62 or similar grounded structure. The channel spacer 90 is removed and the lower portion 88 of the elongated collar 82 is forced into the outer member 12 via the handle 20 to force the lower plug 19 out of the lower aperture 30 of the outer member 12. The device 10 is then inserted into a tank, drum or vessel to collect a sample. Upon collecting a sample, the lower plug 19 is urged back into the lower aperture 30 of the outer member 12 to capture the sample, whereupon, the upper plug 94 is forcibly urged into the upper aperture 28 in the outer member 12 via the washer 92, the first end 110 of the spring 86 is compressed against the conical outer wall 108 of the second clamp retainer 100 via the first end 116 of the channel spacer 90 forcibly urging the second end 118 of the spring 86 axially toward the conical outer wall 108, and the channel spacer 90 is disposed upon the lower portion 88 of the elongated collar 82 such that the second end 120 of the channel spacer 90 forcibly engages the first side 122 of the washer 92, thereby forcibly and constantly urging the upper and lower plugs 94 and 19 into the outer member 12 to maintain the sample within the outer member after the outer member 12 is withdrawn from the tank, drum or vessel.

Referring now to FIGS. 13-17, an alternative a device for electrically discharging the static charge on samples of an electrically non-conductive liquid in accordance with the present invention is denoted as numeral 130. Unlike the previous static discharge device 10 made from metal, the present alternative device 130 is manufactured from a rigid, resistive or "non-metal" material that includes but is not limited to Polyvinyl Chloride, Poly-olefin and similar plastic materials having resistance parameters ranging from 10E5 to 10E12 ohms per inch, and a preferred resistance value of 1.5×10E10 ohms per inch. The plastic materials are supplied by Polytec Plastics, Inc., 3730 Stern Ave., St. Charles, Ill. 60174.

The benefit of the resistive material is that it limits the amount of energy than can be transferred from the alternative device 130 to a grounded surface via a grounding cable, thereby preventing a spark from occurring that could cause an explosion or a fire. More specifically, the resistive material has a sufficiently small conductivity parameter that promotes a safe rate of discharge of static electricity accumulated upon the device 130 from the device 130 collecting a sample of a non-conductive liquid with a dangerously high electro-statically charge. The metal components of the previous sample collection device 10 have an excessively large conductivity parameter that allow an unsafe rate of discharge of static electricity when a dangerously charged non-conductive liquid is collected by the grounded metallic device 10.

The device 130 includes an outer member 132 or tube having upper and lower apertures 134 and 136, and an inner member 138 or rod that is removably received by the tube 132. The outer and inner members 132 and 138 are fabricated from resistive material described above, and can vary in length to accommodate a required insertion depth into a vessel 144 (not part of the invention) containing an electrically non-conductive liquid 146 (not part of the invention) from which a sample is to be taken by the device 130. The cross-sectional configurations for the tube 132 and rod 138 inserted therein are both cylindrical (see FIG. 17) and co-axial. The diameter of the inner wall 140 of the outer member 132 is substantially about double to four times the diameter of the solid inner member 138 with the co-axial configuration being maintained by one or more cylindrical conductor rings 142 having a central aperture that snugly receives an outer wall 139 of the inner member 138. The conductor ring 142 has an outer diameter that promotes a snug engagement between the ring 142 and the inner wall 140 of the outer member, thereby maintaining the axial alignment of the outer and inner members 132 and 138. The conductor ring 142 is fabricated from a relatively rigid semi-conductive rubber such as Nitrile, Buta N Nitrile or Neoprene with carbon or other semi-conductive material added thereto to maintain axial alignment and to promote the removal of static charge from the inner member 138 to the outer member 132, then through the grounding members of the device 130.

The inner member 138 includes a preselected longitudinal dimension that disposes a first end portion 148 of the inner member 138 a cooperating distance outside of the upper aperture 134 of the outer member 132 to allow an electrically resistive biasing member 150 to be manually urged to engage the first end portion 148 of the inner member 138. The biasing member 150 is configured and dimensioned to snugly receive the inner member 138 within a longitudinal recess or channel 152 in the biasing member when the biasing member 150 is manually urged to engage the first end portion 148 of the inner member 138. The biasing member 150 includes a top surface 154 that ultimately engages a bottom surface 156 of an electrically resistive grounding collar 158 secured to the first end portion 148 of the inner member 138 above the biasing member 150. Further, the biasing member 150 includes a bottom surface 166 that engages a top surface 168 of an upper plug 170 that is slidably disposed upon the first end portion 148 of the inner member 138. The biasing member 150 is secured to the inner member 138 via a retaining stud 151 detachably disposed through a lower portion 153 of the biasing member 150 such that the biasing member 150 is allowed to pivot upon the retaining stud 151 when the biasing member 150 is manually urged to engage the inner member 138, thereby forcibly inserting the inner member 138 into the channel 152 and disposing the biasing member 150 into longitudinal alignment with the inner and outer members 138 and 132.

The longitudinal dimension of the inner member 138 is sufficiently long to extend a second end portion 169 of the inner member 138 a cooperating distance outside of the lower aperture 136 of the outer member 132 to allow a lower plug 171 to be slidably disposed upon the second end portion 169, after the inner member 138 has been inserted through the outer member 132 via the upper aperture 134 with the grounding collar 158, biasing member 150 and upper plug 170 disposed upon the first end portion 148. The relative position of the lower plug 171 is ultimately maintained by a top surface 175 of a threaded retaining nut 173 engaging a lower surface 177 of the lower plug 171. The retaining nut 173 is rotational secured to threads disposed upon the second end portion 169 of the inner member 138. The longitudinal dimensions of the outer and inner members 132 and 138 cooperate with the positioning of the upper and lower plugs 170 and 171 to provide the means for allowing the electrically non-conductive liquid 146 to enter the outer member 132 when the device 130 is disposed in the non-conductive liquid 146. The lower plug 171 and the retaining nut 173 ultimately cooperate to forcibly insert the lower plug 171 into the lower aperture 136 after the non-conductive liquid 146 has entered the outer member 132, thereby trapping the non-conductive liquid 146 in the outer member 132. The inner member 132, outer member 138, conductor ring and grounding collar 158 cooperate to provide the primary means for electrically discharging the non-conductive liquid 146 entering and ultimately captured by the outer member 138.

To improve the biasing parameter (if required) of the biasing member and to increase the grip upon the relative smooth top surface 154 of the biasing member 150 to maintain the position of the biasing member 150 after being manually urged into axial alignment with the outer and inner members 132 and 138, a frusto-conically configured, deformable biasing spacer 160 is slidably disposed upon the first end portion 148 of the inner member 138 by forcibly inserting the first end portion 148 through a central aperture 161 that extends through the biasing spacer 160. The biasing spacer 160, like the conductor ring 142, is fabricated from a relatively rigid, semi-conductive rubber such as Nitrile, Buta N Nitrile or Neoprene (all well known to those of ordinary skill in the art) with carbon or other semi-conductive material added thereto. The biasing spacer 160 includes a top surface 162 having a diameter substantially equal to the diameter of the bottom surface 156 of the grounding collar 158 engaged by the top surface 162. The biasing spacer further includes a bottom surface 164 that is relatively larger in diameter than the top surface 160, and sufficiently large to maintain the position of the biasing member 150 after the bottom surface 164 ultimately engages the top surface 154 of the biasing member 150, thereby forcibly urging the bottom surface 166 of the biasing member 150 against the top surface 168 of the upper plug 170 that is forcibly urged into the upper aperture 134 of the outer member 132 after the inner member 138 has been inserted into the outer member 132.

The upper and lower plugs 170 and 171 are frustoconically configured and dimensioned to cooperate with the inner diameter of the outer member 132 such that the upper and lower plugs 170 and 171 are capable of sealing the upper and lower apertures 134 and 136 in the outer member 132 after the non-conductive liquid 146 enters the outer member 132, thereby allowing the non-conductive liquid 146 to be manually transported. The upper and lower plugs 170 and 171 are fabricated from the same relatively rigid, deformable, semi-conductive rubber that the conductor ring 142 is manufactured from. The upper and lower plugs 170 and 171 are capable of returning to an original configuration after the plugs are removed from the outer member 132. The upper plug 170 is slidably disposed upon the first end portion 148 of the inner member 138 by forcibly inserting the first end portion 148 through a central aperture 172 that extends through the upper plug 170. The biasing member 150 and spacer 160 cooperate to maintain a force or bias upon the upper plug 170 to maintain the upper plug 170 inside the outer member 132 such that the electrically non-conductive liquid 146 inside the outer member 132 will not escape the outer member 132 via the upper aperture 134 irrespective of the orientation of the outer member 132. Further, the biasing member 150 and spacer 160 cooperate with the upper plug 170 to promote the electrical discharge of the non-conductive liquid 146, while preventing the liquid 146 from escaping the outer member 132.

The grounding collar 158 may be manufactured from the same plastic materials as the outer and inner members 132 and 138, or from a myriad of metals including but not limited to aluminum, copper, stainless steel and similar highly conductive materials. The grounding collar 158 is cylindrically configured with an aperture 174 axially disposed therethrough to snugly and slidably receive the inner member 138 such that a top end 176 of the inner member 138 is extends above or is substantially planar with a top surface 178 of the grounding collar 158. A retaining screw 180 is removably driven into the top surface 178 to removably secure a first end 182 of a grounding cable 184 to the grounding collar 158. The grounding collar 158 is forcibly secured to the inner member 138 via a manually rotated knob 186 integrally joined to a threaded stud 188 protruding therefrom, the threaded stud 188 being rotationally inserted through a threaded aperture 190 radially disposed through a cylindrical side wall 192 of the grounding collar 158. The threaded stud 188 is rotationally inserted through the aperture 190 until an end surface 194 of the stud 188 engages the inner member 138 after being inserted through the axial aperture 174, thereby retaining the position of the grounding collar 158 upon the inner member 138 irrespective of the orientation of the device 130 and the bias generated by the biasing member 150 and spacer 160 upon the upper plug 170.

Figure 18:
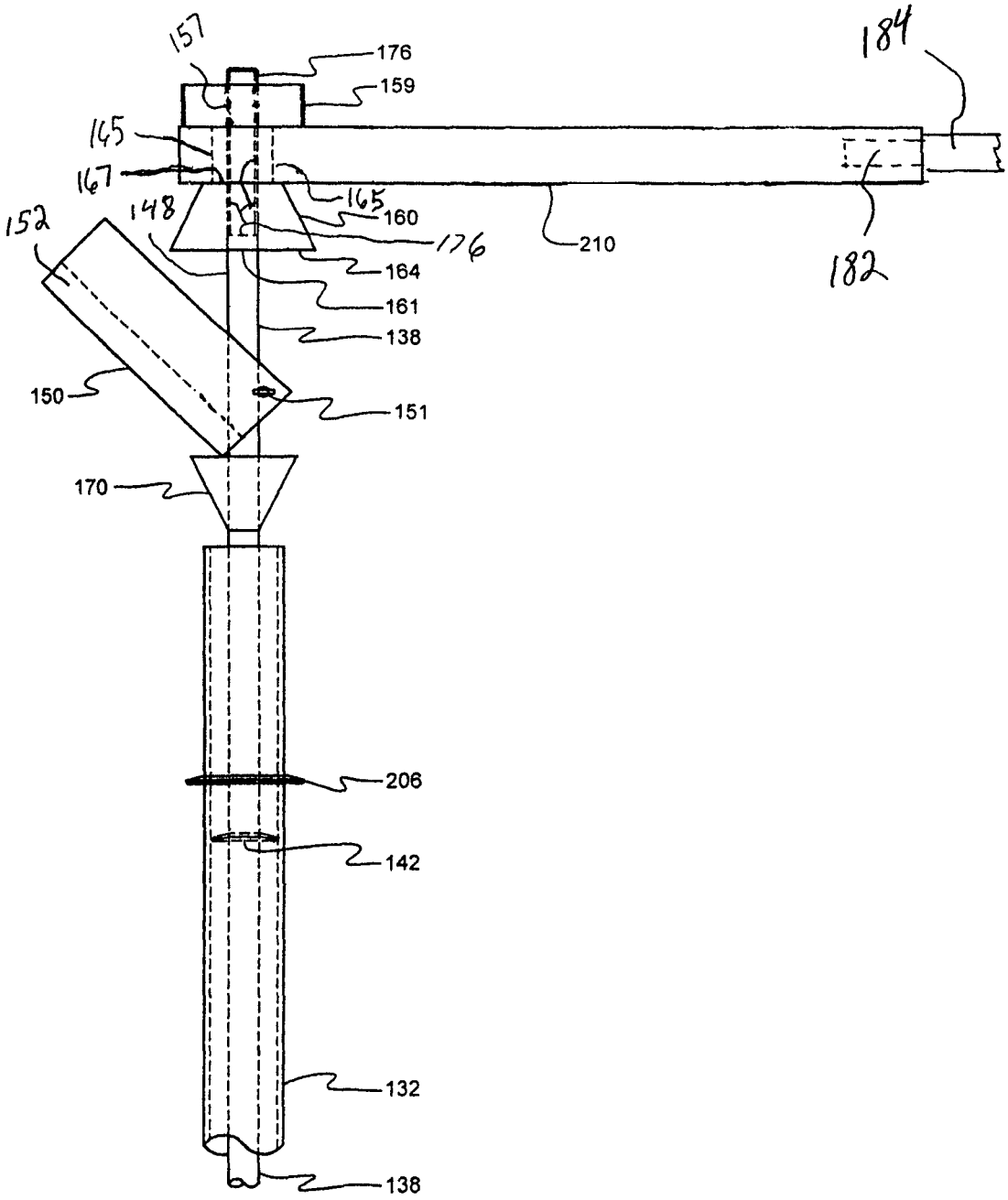
FIG. 18 is a front elevation view of a top portion of the alternative device with alternative grounding components secured to a first end portion of an inner member in accordance with the present invention.

Referring now to FIG. 18, the grounding collar 158 has been replaced by a manually rotated, electrically resistive grounding handle 159 with a central, threaded aperture 157 that receives that rotationally receives a threaded top end 176 of the inner member 138. The handle 159 can be fabricated from the same resistive material as the outer and inner members 132 and 138, or the handle 159 can be fabricated from aluminum or similar conductive material. Unlike the grounding collar 158 that is coupled to the inner member 138 via the threaded stud 188 acting as a "set screw," the handle 159 promotes a tighter and more secure retention of the inner member 138 such that the relative position of the inner member 138 relative to the outer member 132 will not vary irrespective of the force generated by the biasing member 150. The handle 159 includes a cylindrical neck portion 165 that is dimensioned to snugly receive a top ground clamp 210 that is secured to the first end 182 of the grounding cable 184 thereby replacing the retaining screw 180. A bottom wall 167 of the neck portion 165 ultimately engages the top surface 162 of the biasing spacer 160 when the biasing member 150 is forcibly urged to engage the inner member 138 via the channel 152 thereby compressing the upper plug 170 into the upper aperture 134 of the outer member 132. Further, the threaded aperture 157 of the handle 159 cooperates with the threaded top end 176 of the inner member 138 and the top ground clamp 210 to provide a more reliable and secure ground "path" for the static charge ultimately removed from the non-conductive liquid 146. The top ground clamp 210 may be dimensioned such that the clamp 210 can be secured to both the neck portion 165 and the biasing spacer 160 to increase the rate of electrical discharge of the non-conductive liquid 146.

To reduce the resistance of the handle 159 of FIG. 18 and increase the rate of discharge of the non-conductive liquid 146, a handle 159 with a central, threaded aperture 157 but without a neck portion 165, is secured to the threaded top end 176 of the inner member 138. The top ground clamp 210 is then secured to the inner member 138 between the handle 159 and the biasing spacer 160. After securing the clamp 210 to the inner member 138, the biasing member 150 is forcibly urged to longitudinally engage the inner member 138 such that the inner member is longitudinally disposed in the channel 152, thereby urging the biasing spacer 160 against the top ground clamp 210 to maintain the clamp 210 between the handle 159 and the biasing spacer 160, while forcing the upper plug 170 into the upper aperture 134 of the outer member 132. Thus, an increased rate of electrical discharge of the non-conductive liquid 146 is achieved and the liquid 146 is prevented from escaping past the upper plug 170 irrespective of the orientation of the outer member 132.

The grounding cable 184 includes a mid-portion 196 that is electrically joined to a first grounding clamp 198 that is ultimately secured to a top portion 200 of the outer member 132. The grounding cable 184 further includes a second end 202 that is electrically joined to a second grounding clamp 204 that is ultimately secured to an electrically grounded structure 144 that is normally the vessel that contains the electrically non-conductive liquid 146 that enters the outer member 132. Other grounding locations can be used so long as safety is not compromised. After the grounding cable 184 has been connected to the grounding collar 158 (or the neck portion 165 of the handle 159), outer member 132 and electrical ground via the cooperating retaining screw 180 and grounding clamps 198 and 204 thereby safely grounding the device 130, the outer and inner members 132 and 138 are lowered into the electrostatically charged non-conductive liquid 146 to collect a quantity of the liquid 146. As soon as the retaining nut 173 engages the charged liquid 146 and as the outer and inner members 132 and 138 are inserted deeper into the liquid 146, the device 130 discharges the liquid 146 at a rate that will not cause a spark, which could cause a fire and/or explosion. As the liquid 146 fills the outer member 132, the electrostatically charged liquid 146 is continuously discharged until the required quantity is collected, whereupon, the outer and inner members 132 and 138 are removed from the liquid 146 without causing a spark. A scraper ring 206 is snugly and slidably disposed upon and about an outer wall 208 of the outer member 132. The scraper ring 206 forcibly slid upon the outer wall 208 to remove any liquid 146 clinging upon the outer wall 208 after the outer member 132 is removed from the liquid 146.

Figures 13, 17:
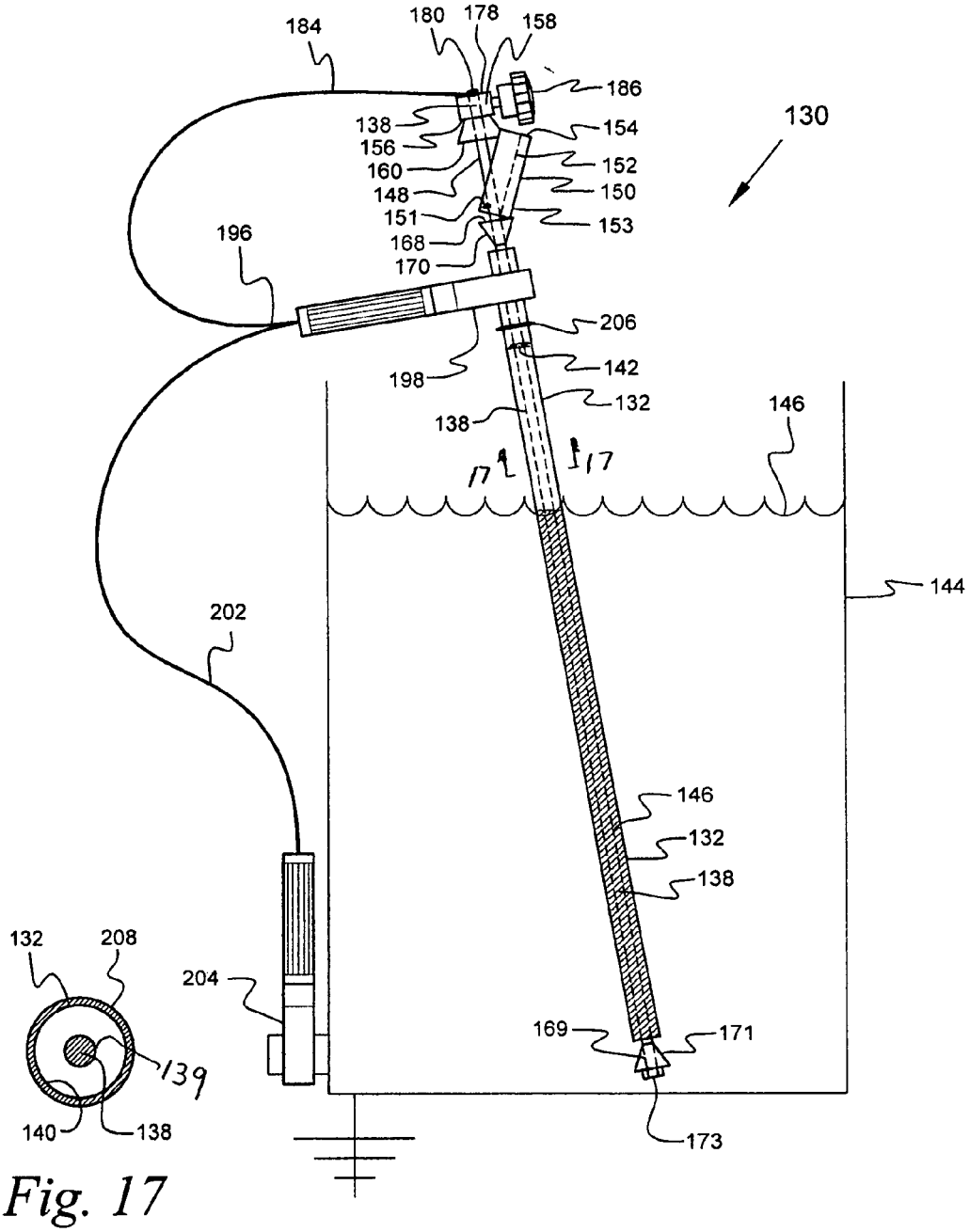
FIG. 13 is a front elevation view of an alternative device for electrically discharging the static charge in samples of an electrically non-conductive liquid, the alternative device being disposed in a vessel to receive the liquid in accordance with the present invention.
FIG. 17 is a sectional view taken along line 17-17 of FIG. 13.
Figure 14:
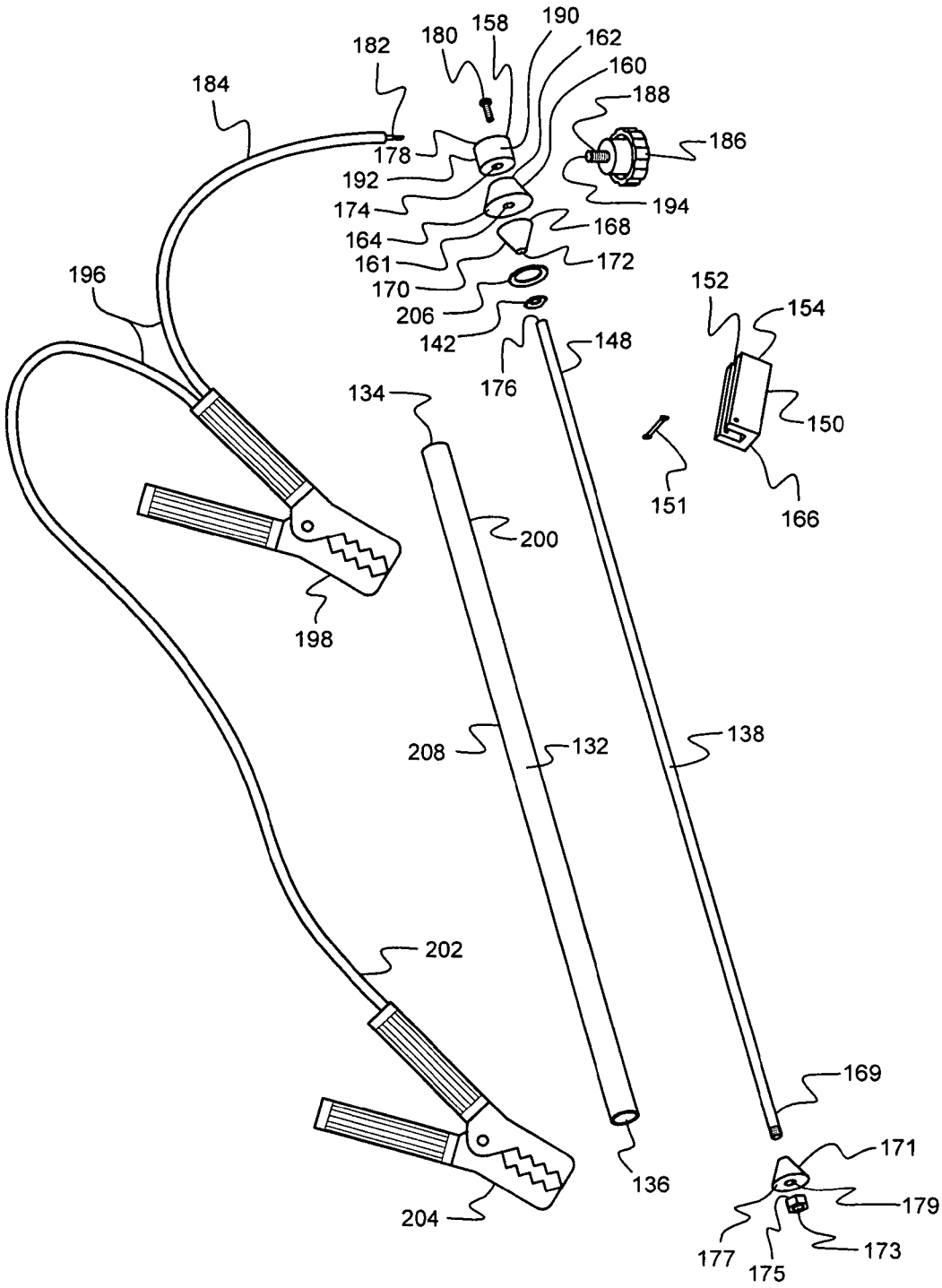
FIG. 14 is an exploded view of the alternative device of FIG. 13.
Figure 15:
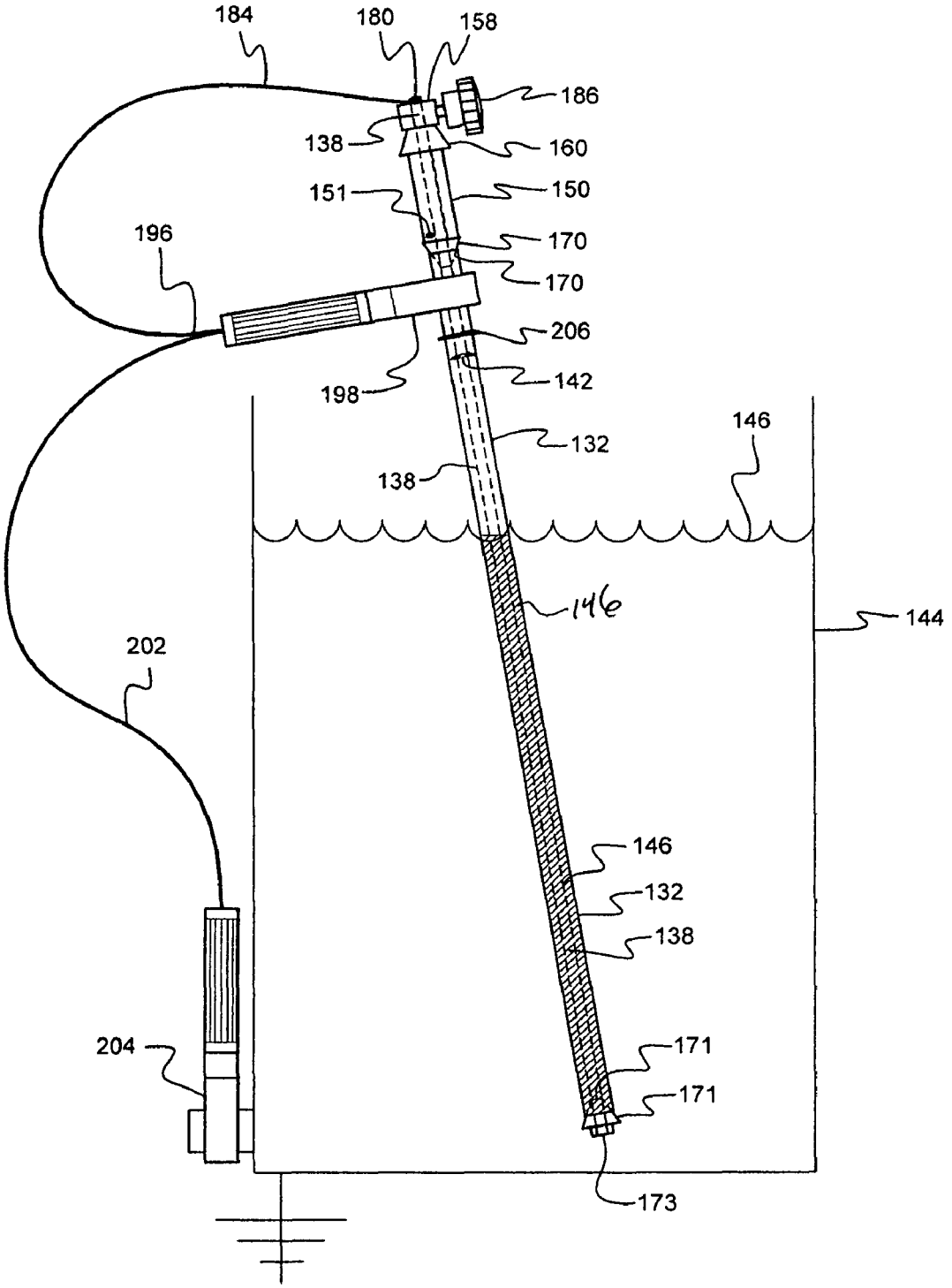
FIG. 15 is a front elevation view of the alternative device of FIG. 13, but with the device being disposed in the vessel with a lower plug in a sealed position in accordance with the present invention.
Figure 16:
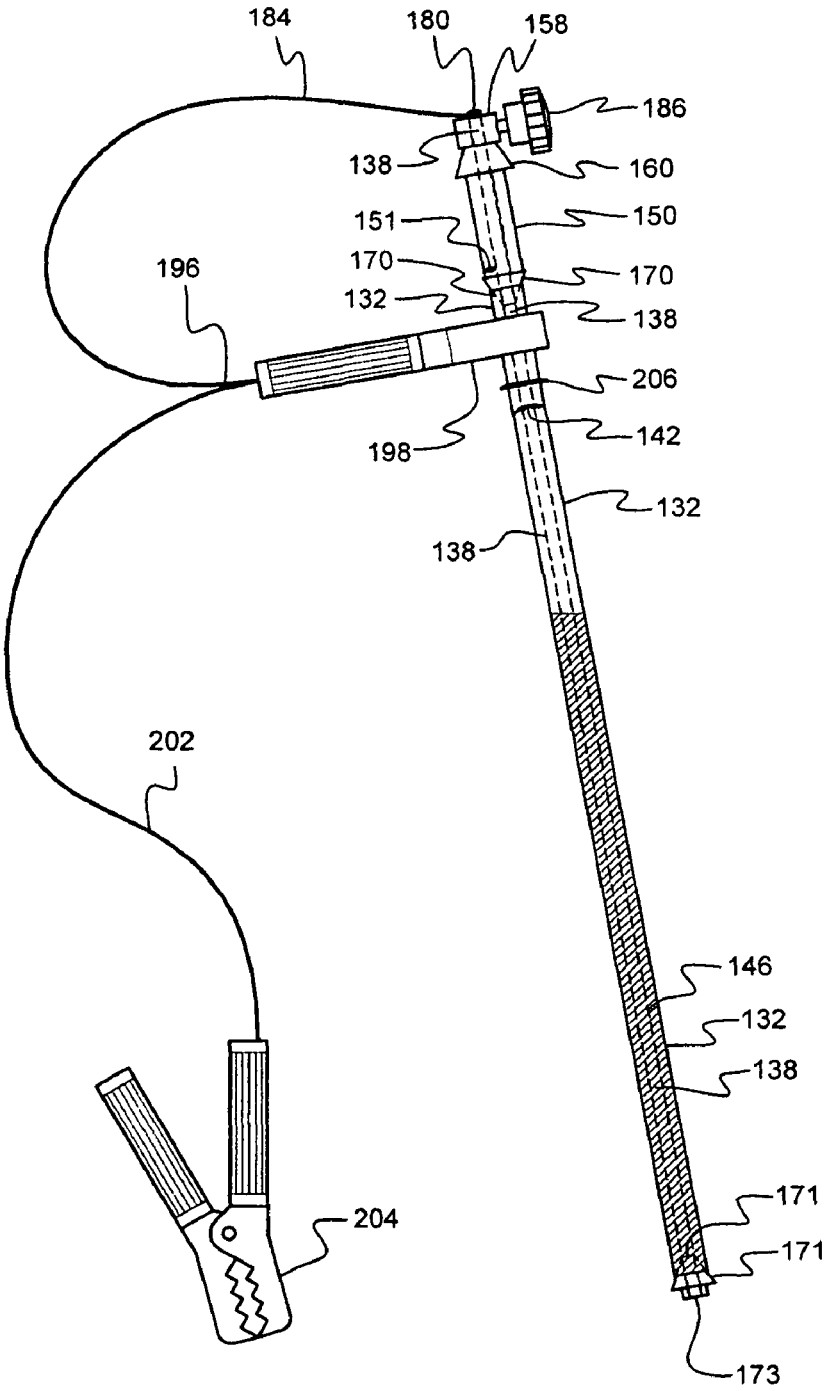
FIG. 16 is front elevation view of the alternative device of FIG. 15, but with the device removed from the vessel and upper and lower plugs in sealed positions to trap the non-conductive liquid therein for transport.

In operation, the device 130 is first grounded as depicted in FIG. 13. The biasing member 150 is angularly positioned and the upper and lower plugs 170 and 171 are positioned to open the upper and lower apertures 134 and 136. The outer member 132 is then inserted into the electrically non-conductive liquid 146 to allow the liquid 146 to enter the outer member 132. Referring to FIG. 15, after a sufficient quantity of liquid 146 has entered the outer member 132, the inner member is forcibly extracted a distance that forces the lower plug 171 to seal the lower aperture 136. The upper plug 170 is then manually urged into the upper aperture 134, whereupon, the biasing member 150 is manually urged into axially alignment with the outer and inner members 132 and 138, resulting in the biasing member 150 forcibly engaging the biasing spacer 160 and the upper plug 170, thereby maintaining the sealing of the upper and lower apertures 134 and 136 by the upper and lower plugs 170 and 171, irrespective of the orientation of the outer member 132 after the device 130 is removed from the liquid 146 and vessel 144 (see FIG. 16).

Figure 3:
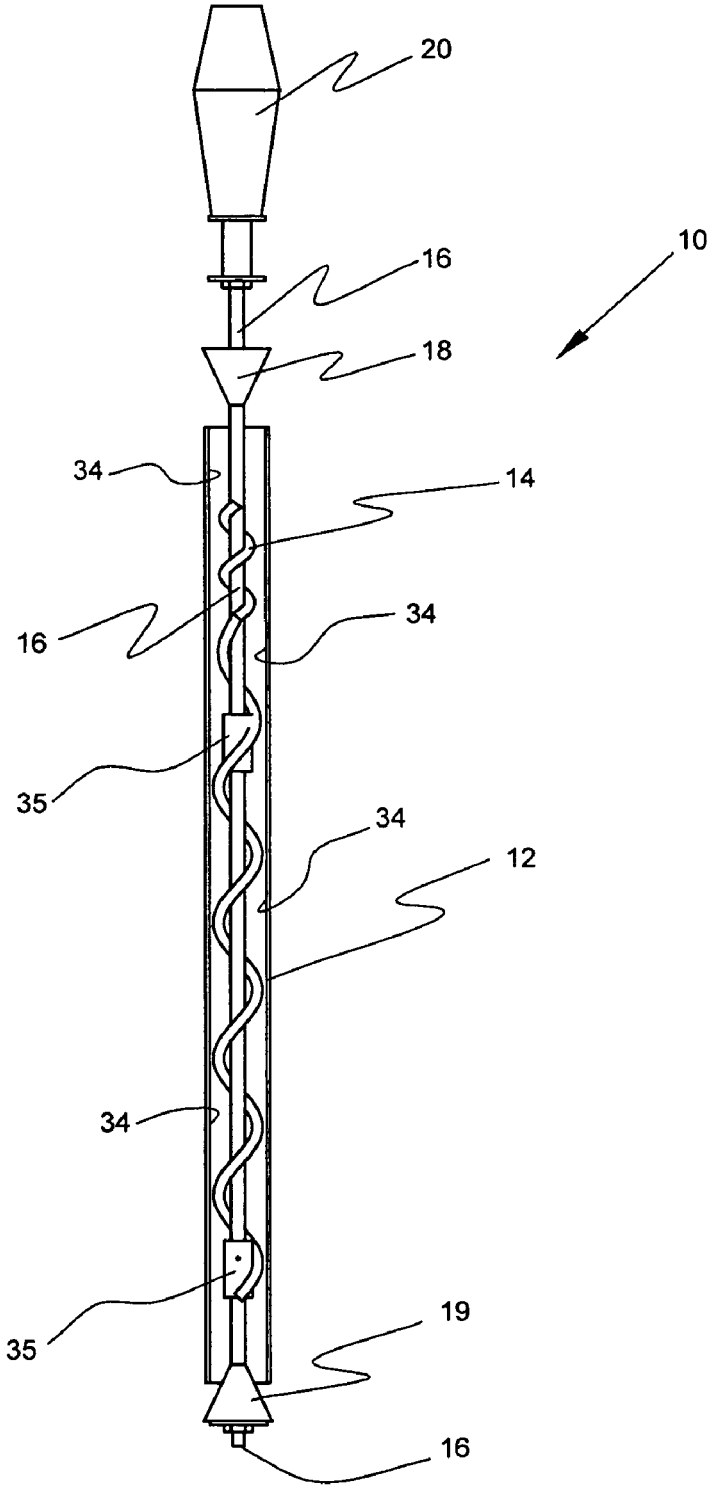
FIG. 3 is a phantom view of the device of FIG. 1 without the grounding cable.

The alternative device 130 as described above may not provide sufficient discharge characteristics for a given electrically charged non-conductive liquid 146. To achieve safe discharge rates for the liquid 146 in the outer member 132, and to discharge the liquid 146 to a static charge quantity that will not promote a spark should the outer member 132 engage an electrically grounded surface, the alternative device 130 can be modified to include the components of the original device 10. More specifically, the spiral inner member 14 depicted in FIGS. 2 and 3, the balls 36 of FIGS. 4 and 5, the screens 38 of FIGS. 5 and 5*a*, or the flat bars 40 and grid 42 of FIGS. 6 and 6*a* may be used separately or in any combination with the alternative device 130 to achieve safe static discharge requirements for the static charge quantities on and in any non-conductive liquid 146. Further, the components of the original device 10 can be manufactured from the metal or resistive materials described above in any combination to achieve the required electrical resistive parameters of the alternative device 130 that prevent sparks by sufficiently discharging the electrically non-conductive liquid 146 that ultimately engages the outer and inner members 132 and 138.

For example, if the static charge contained in the non-conductive liquid 146 is relatively large, a plurality of resistive and/or metal balls 36 would be disposed in the outer member 132 such that the balls 36 engage the outer wall 139 of the inner member 138 and the inner wall 140 of the outer member 132. Further, the balls 36 are submersed in the non-conductive liquid 146 contained in the outer member 132 thereby increasing the quantity and rate of discharge of static electricity from the electrically non-conductive liquid 146. The quantity and rate of electrical discharge of the static electricity in the liquid 146 can be further increased by disposing a plurality of resistive and/or metal screens 38 together with the balls 36 in the outer member 132. The screens 38 are configured and dimensioned to snugly engage the inner wall 140 of the outer member 132 and the outer wall 139 of the inner member 138, thereby cooperating with the balls 36 to increase the quantity of discharge of static electricity from the electrically non-conductive liquid 146.

The foregoing description is for purposes of illustration only and is not intended to limit the scope of protection accorded this invention. The scope of protection is to be measured by the following claims, which should be interpreted as broadly as the inventive contribution permits.

The invention claimed is:

1. A device for electrically discharging samples of an electrically non-conductive liquid comprising:

an outer member having upper and lower apertures, said outer member being manufactured from an electrically resistive material;

an inner member disposed within said outer member, said inner member being manufactured from an electrically resistive material, said electrically resistive inner member including a preselected longitudinal dimension that disposes a first end portion of said inner member a distance outside of said electrically resistive outer member to allow said biasing means to be manually urged to engage said first end portion of said inner member, said biasing means including a biasing member configured and dimensioned to snugly receive said inner member when said biasing member is manually urged to engage said first end portion of said inner member, said biasing member including a top surface that ultimately engages a bottom wall of an electrically resistive grounding handle secured to said top portion of said inner member above said biasing member;

means for allowing an electrically non-conductive liquid to enter said electrically resistive outer member when said device is disposed in the non-conductive liquid;

means for electrically discharging the non-conductive liquid entering said outer resistive member;

means for maintaining a selected volume of the non-conductive liquid in said outer resistive member after said device is removed from the non-conductive liquid, said maintaining means includes a manually positioned biasing means, said biasing means ultimately engaging said inner member, thereby promoting the electrical discharge of the non-conductive liquid while preventing the liquid from escaping said outer member irrespective of the orientation of said outer member; and means for electrically grounding said electrically resistive inner and outer members, whereby a spark is not generated when the device engages the non-conductive liquid or when the device is removed from the non-conductive liquid with the sample therein.

2. The device of claim 1 wherein said electrically resistive outer member includes cylindrically configured inner and outer walls.

3. The device of claim 1 wherein said electrically resistive inner member includes a cylindrically configured rod.

4. The device of claim 1 wherein said electrically resistive inner member receives an upper plug slidably secured to said first end portion of said inner member, said inner member ultimately receives a lower plug slidably disposed upon a second end portion of said inner member after said inner member has been inserted into said outer member such that said second end portion of said inner member extends through a lower aperture of said outer member, said second end portion of said inner member ultimately receiving a retaining nut upon said second end portion of said inner member such that a top surface of said retaining nut engages a lower surface of said lower plug, said lower plug and said retaining nut ultimately cooperating to forcibly insert said lower plug into said lower aperture after a non-conductive liquid has entered said outer member, thereby trapping the non-conductive liquid in said outer member.

5. The device of claim 4 wherein said electrically resistive biasing means includes a deformable biasing spacer slidably disposed upon said inner member, said biasing spacer includes a top surface that engages said bottom wall of said grounding handle, said biasing spacer having a bottom surface that ultimately engages said top surface of said biasing member to forcibly urge a bottom surface of said biasing member against a top surface of said upper plug, thereby forcibly urging said upper plug into said upper aperture of said outer member after said inner member has been inserted into said outer member.

6. The device of claim 5 wherein said biasing member includes a retaining stud detachably disposed through a lower portion of said biasing member such that said biasing member is allowed to pivot upon said retaining stud when said biasing member is manually urged to engage said inner member, thereby disposing said biasing member into longitudinal alignment with said inner and outer members.

7. The device of claim 6 wherein said upper and lower plugs are frustoconically configured and dimensioned to cooperate with the inner diameter of said electrically resistive outer member, such that said plugs are capable of sealing bottom and top apertures in said outer member after a non-conductive liquid enters said outer member, thereby allowing said non-conductive liquid to be manually transported.

8. The device of claim 1 wherein said grounding handle is forcibly secured to said inner member via a threaded aperture, said threaded aperture rotationally receiving a threaded first end portion of said inner member, thereby retaining the position of said grounding handle upon said inner member irrespective of the orientation of the device and the bias generated by said biasing means.

9. The device of claim 1 wherein said electrical grounding means includes a grounding cable having a first end removably secured to a grounding collar via a retaining screw.

10. The device of claim 9 wherein said grounding cable includes a mid-portion electrically joined to a first grounding clamp, said first grounding clamp being ultimately secured to a top portion of said outer member.

11. The device of claim 10 wherein said grounding cable includes a second end electrically joined to a second grounding clamp, said second grounding clamp being ultimately secured to a grounded structure.

12. The device of claim 1 wherein said outer member includes a plurality of electrically conductive balls disposed therein such that said balls engage an outer wall of said inner member and an inner wall of said outer member, said balls being submersed in the non-conductive liquid contained in said outer member to increase the quantity and/or rate of discharge of static electricity from the electrically non-conductive liquid.

13. The device of claim 12 wherein said outer member includes a plurality of screens configured and dimensioned to snugly engage said inner wall of said outer member and said outer wall of said inner member, thereby increasing the quantity and/or rate of discharge of static electricity from the electrically non-conductive liquid.

14. The device of claim 1 wherein said outer member includes a scraper ring for removing electrically non-conductive liquid from the outer wall of said outer member after said outer member is removed from the liquid.

15. The device of claim 1 wherein said inner member includes an electrically resistive conductor ring for maintaining axial alignment and electrical continuity between said inner and outer members.

16. The device of claim 1 wherein said electrically resistive inner and outer members, said biasing means, and said maintaining means are fabricated from material having a resistivity parameter of substantially about 1.5×10E10 ohms per inch.

17. A device for electrically discharging samples of an electrically non-conductive liquid comprising:

an outer member having upper and lower apertures, said outer member being manufactured from an electrically resistive material;

an inner member disposed within said outer member, said inner member being manufactured from an electrically resistive material, said electrically resistive inner and outer members being fabricated from materials having resistivity parameters ranging between 10E5 and 10E12 ohms per inch;

means for allowing an electrically non-conductive liquid to enter said electrically resistive outer member when said device is disposed in the non-conductive liquid;

means for electrically discharging the non-conductive liquid entering said outer resistive member;

means for maintaining a selected volume of the non-conductive liquid in said outer resistive member after said device is removed from the non-conductive liquid, said maintaining means includes a manually positioned biasing means, said biasing means ultimately engaging said inner member, thereby promoting the electrical discharge of the non-conductive liquid while preventing the liquid from escaping said outer member irrespective of the orientation of said outer member; and means for electrically grounding said electrically resistive inner and outer members, whereby a spark is not generated when the device engages the non-conductive liquid or when the device is removed from the non-conductive liquid with the sample therein.

18. A system for electrically discharging non-conductive liquid samples such that a spark is not generated when removing the liquid sample from a vessel comprising:

means for receiving a predetermined quantity of non-conductive liquid, said receiving means having electrically resistive parameters;

means for electrically discharging the non-conductive liquid as the non-conductive liquid enters and fills said receiving means, said electrical discharging means comprising:

an electrically resistive inner member that engages the non-conductive liquid entering said receiving means, said inner member being fabricated from materials having resistivity parameters ranging between 10E5 and 10E12 ohms per inch; and means for grounding said inner member, said grounding means being detachably secured to said electrically resistive inner member and an electrically grounded structure;

means for manually sealing a predetermined quantity of the non-conductive liquid in said receiving means; and means for manually releasing the non-conductive liquid from said receiving means, thereby providing a sample of the non-conductive liquid for evaluation.

* * * * *